US007464445B1

(12) United States Patent
Lin

(10) Patent No.: US 7,464,445 B1
(45) Date of Patent: Dec. 16, 2008

(54) CAP STRUCTURE FOR ZIPPER

(76) Inventor: Yu-Pau Lin, No. 151, Kung Erh Road, Wu Lin Tsuen, Tao Yuan Hsien (TW)

( * ) Notice: Subject to any disclaimer, the term of this patent is extended or adjusted under 35 U.S.C. 154(b) by 0 days.

(21) Appl. No.: 11/819,765

(22) Filed: Jun. 29, 2007

(51) Int. Cl.
*A44B 19/26* (2006.01)

(52) U.S. Cl. ..... 24/415; 24/429

(58) Field of Classification Search ..... 24/415, 24/421–425, 429, 430
See application file for complete search history.

(56) References Cited

U.S. PATENT DOCUMENTS 5,625,928 A * 5/1997 Terada et al. ..... 24/424
6,993,810 B2 * 2/2006 Hamada ..... 24/424

* cited by examiner

*Primary Examiner*—James R Brittain
(74) *Attorney, Agent, or Firm*—Rosenberg, Klein & Lee

(57) ABSTRACT

A cap structure for a zipper includes a cap and a resilient tab. The cap has a containing groove formed on the bottom surface thereof. At least one lug is disposed on the bottom surface of the containing groove. The bottom of the concave portion is lower than the top of the lug. Two sides of the cap each have a side wall. Each of the side walls has a recess opening that communicates with the containing groove. The resilient tap is disposed within the containing groove and the resilient tap abuts against the limiting portions. One end of the resilient tap has an aperture that corresponds to the lug. Therefore, the resilient tap and cap are combined to form the cap structure. Because the space for the resilient tap to bend is bigger, the force for pulling the slide of the zipper is smaller.

9 Claims, 5 Drawing Sheets

CAP STRUCTURE FOR ZIPPER

BACKGROUND OF THE INVENTION

1. Field of the Invention

The present invention relates to a cap structure for a zipper and in particular to a cap structure assembled on the slide of the zipper and having a resilient tap installed within the cap structure.

2. Description of Related Art

In general, a slide of a zipper is locked on interlocking teeth of a zipper tape (not shown in the figure). The slide of the zipper structure includes a zipper slide, a pull tab, a hook, a resilient tap, and a cap. The top of the slide of the zipper has two holding bases. A hole of the pull tab is looped around one of the holding bases of the zipper slide. The hook is disposed movably inside of the zipper slide. The resilient tap is disposed on the slide of the zipper and attached to the top of the hook. Furthermore, the cap is covered on the pull tab to lock the resilient tap inside the cap. The top of the pull top passes through a concave portion of the cap.

When a user wants to close or separate the interlocking teeth of the zipper tape, the user needs to pull the pull tab so that the hook pulls the resilient tap. Therefore, a blocking portion of the hook is removed from the interlocking teeth of the zipper tape. The pull tap pulls the slide of the zipper structure to close or separate the interlocking teeth of the zipper tape.

However, when a manufacturer has to assemble the resilient tap with the zipper slide, and then cover the cap on the slide of the zipper to assemble the zipper slide. The assembly of the slide of the zipper is complex and inconvenient. Moreover, a user must use a large force to pull the pull tab to bend the resilient tab. The pulling of the pull tab is difficult.

SUMMARY OF THE INVENTION

It is an object of the present invention to provide a cap structure for a zipper. The cap and the resilient tap are combined previously for assembling the slide of the zipper easier. The resilient tap has an aperture, and the cap has a concave. Therefore, the resilience of the resilient tap is increased, the resilient tap has more space to allow for bending, and the force required to pull the slide of the zipper is less.

To achieve the above object, the present invention provides a cap structure for a zipper. The cap structure for a zipper comprises: a cap having a containing groove formed on the bottom surface thereof; a lug being disposed on the bottom surface of the containing groove; the bottom surface of the containing groove having a concave portion beside of the lug; the bottom of the concave portion being lower than the top of the lug, two sides of the cap having a side wall respectively; each of the side walls having a recess opening communicating with the containing groove; and the side walls having a limiting portion respectively near the recess opening; a resilient tap being disposed within the containing groove; the resilient tap abutting against the limiting portions; and one end of the resilient tap having an aperture corresponding to the lug.

The present invention has a number of advantages, which are described below. The resilient tap is assembled inside the cap to form a cap structure. Therefore, the cap structure is assembled to the slide of the zipper to complete the assembly of the zipper slide. The assembly of the slide of the zipper is easier. Moreover, a user only needs to pull the pull tab with a small force to move the zipper slide.

BRIEF DESCRIPTION OF THE DRAWINGS

The present invention can be fully understood from the following detailed description and preferred embodiments with reference to the accompanying drawings, in which.

DETAILED DESCRIPTION OF THE PREFERRED EMBODIMENTS

The following detailed description is of the best presently contemplated modes of applying the invention. This description is not intended to be taken in a limiting sense, but is made merely for the purpose of illustrating general principles of embodiments of the invention. The scope of the invention is best defined by the appended claims.

Figure 1:
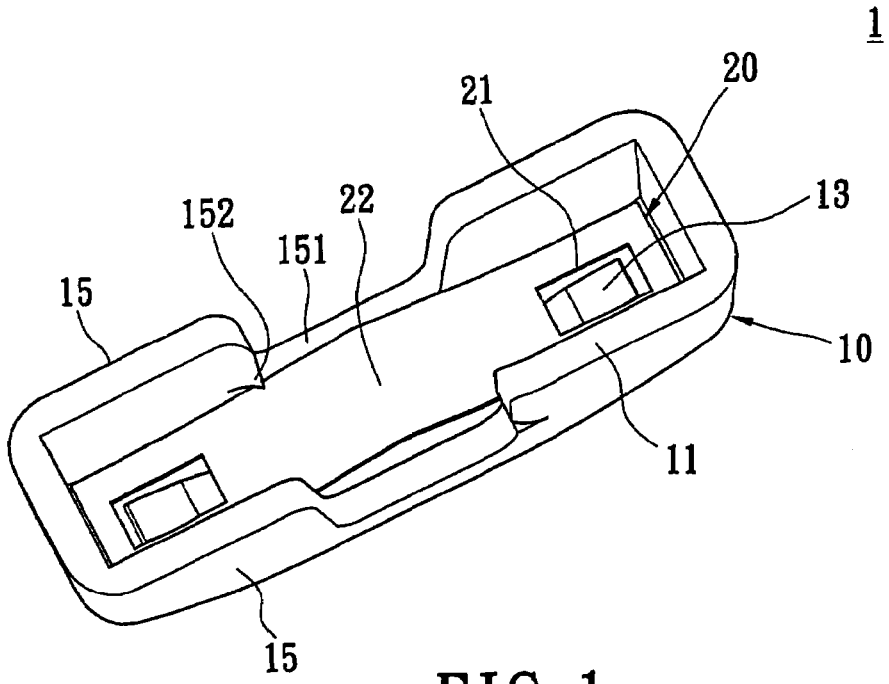
FIG. 1 is a perspective view of the cap structure for a slide of the zipper according to the present invention.
Figure 4:
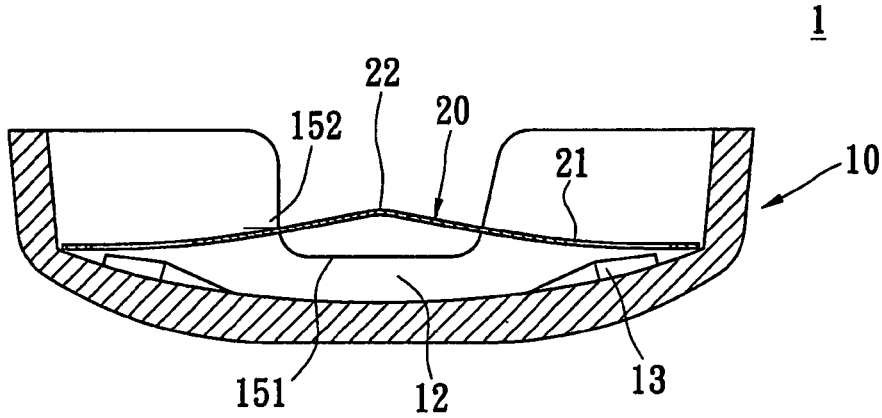
FIG. 4 is a cross-sectional view according to 4-4 of FIG. 3.

Please refer to FIGS. 1 and 4, which show a cap structure for a slide of the zipper of the present invention. The cap structure for a slide of the zipper includes a cap 10 and a resilient tap 20.

The cap 10 has a containing groove 12 formed on the bottom surface 11 thereof. Two lugs 13 are disposed on the opposite ends of the containing groove 12 respectively. The bottom surface of the containing groove 12 has a concave portion 14 between the opposite sides of each of the lugs 13 and the walls of the containing groove 12. The bottom of the concave portion 14 is lower than the top of the lugs 13.

The two lengthwise sides of the cap 10 have a side wall 15 respectively. Each of the side walls 15 has a recess opening 151 communicating with the containing groove 12. The side wall 15 has a limiting portion 152 near the recess opening 151. The limiting portion 152 is bent from the side wall 15 to the containing groove 12. In this embodiment, the two limiting portions 152 are disposed in a diagonal position. However, the position of the limiting portions 152 is not limited. The two limiting portions 152 are disposed in opposite positions.

Figure 6:
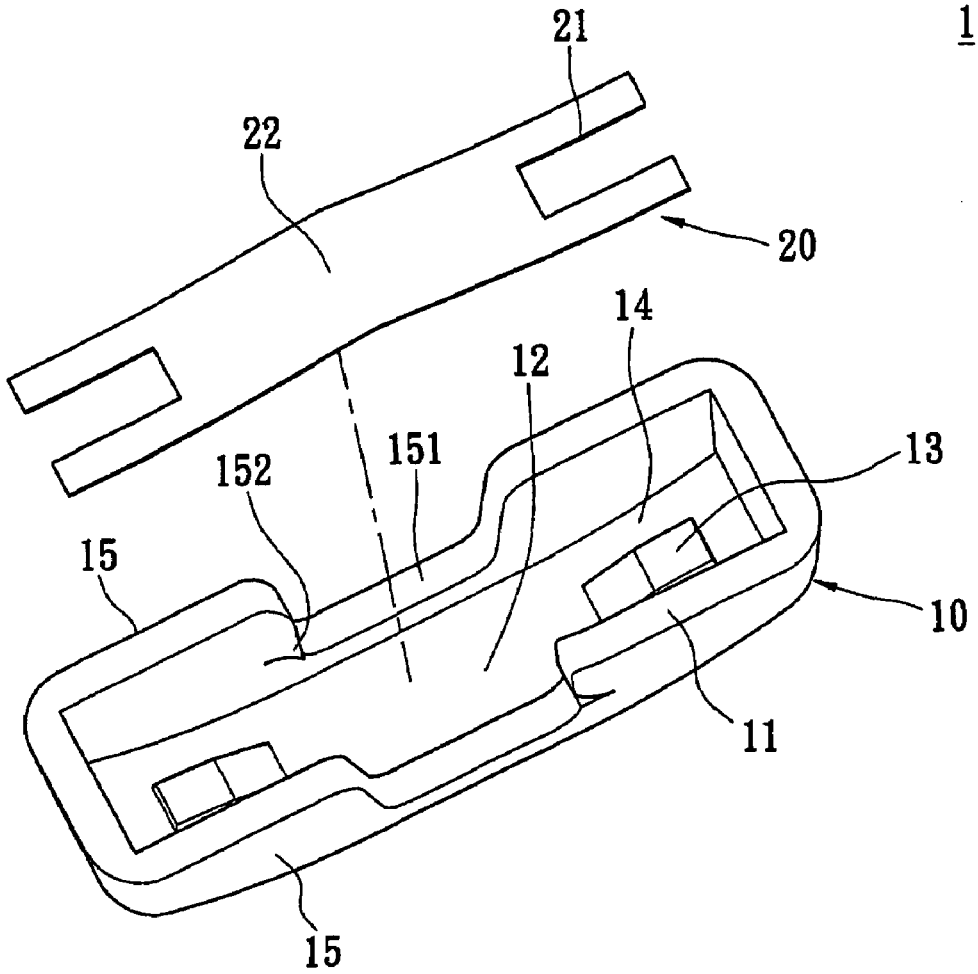
FIG. 6 is an exploded view of the a second embodiment of the cap structure for a slide of the zipper according to the present invention.

The resilient tap 20 is made of resilient metal material. The opposite ends of the resilient tap 20 each have an aperture 21. The apertures 21 correspond to the lugs 13. The apertures 21 pass through a top and a bottom of the resilient tap 20 to increase the resilience the resilient tap 20. In this embodiment, the receiving portions 21 are apertures. However, the receiving portions 21 can be groove and pass through the surfaces of the opposite ends respectively, as shown in FIG. 6. The middle of the resilient tap 20 is bent downwardly to form a contact portion 22.

When assembling the cap structure 1 of the present invention, the resilient tap 20 is disposed within the containing groove 12. The surface of the resilient tap 20 abuts against the limiting portion 152 to prevent the resilient tap 20 dropping out of the containing groove 12 of the cap 10. Therefore, the resilient tap 20 is assembled with the cap 10.

Figure 2:
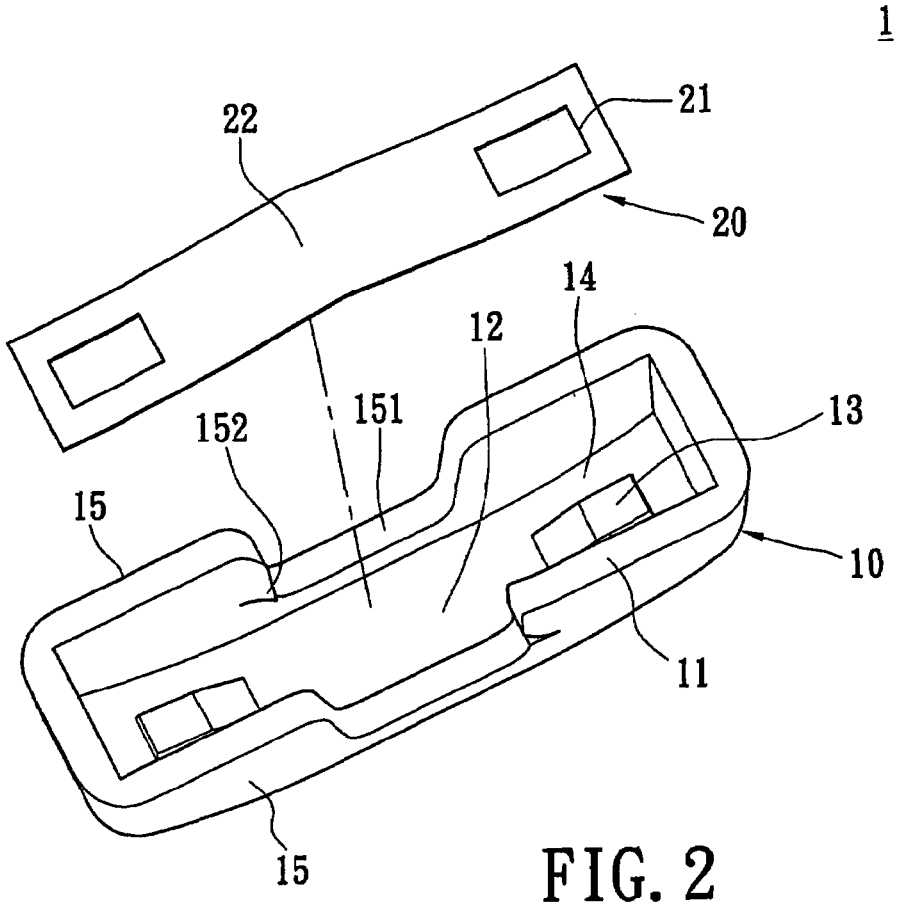
FIG. 2 is an exploded view of the cap structure for a slide of the zipper according to the present invention.
Figure 3:
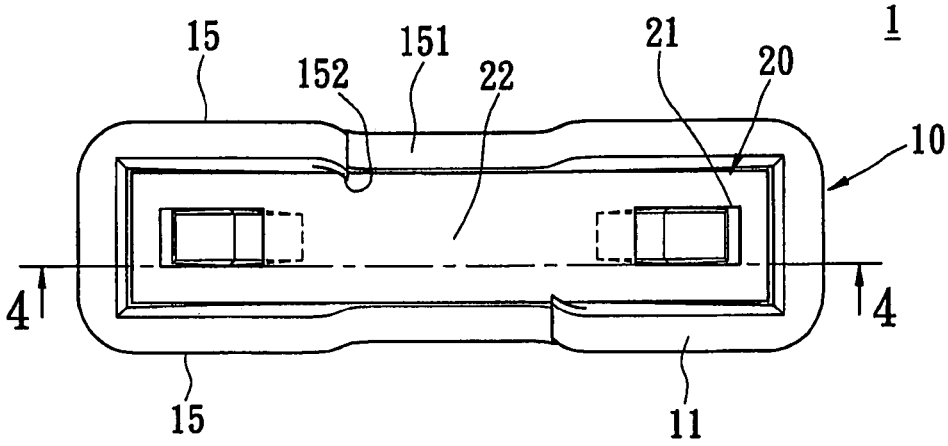
FIG. 3 is a top view of the cap structure for a slide of the zipper according to the present invention.
Figure 5:
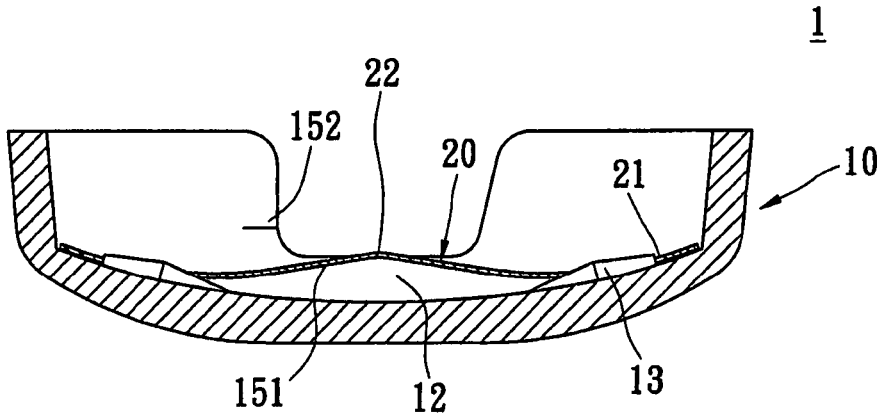
FIG. 5 is a cross-sectional view according to 4-4 of FIG. 3, where in the resilient tap is bended.

Please refer to FIG. 5. When the resilient tap 20 is bended by a force, the lugs 13 respectively pass through the receiving portions 21 to protrude out of the resilient tap 20. Because the bottom of the concave portion 14 (please refer to FIG. 2) is lower than the top of the lugs 13, the two ends of the resilient tap 20 can contact the bottom of the containing groove 12.

Figure 7:
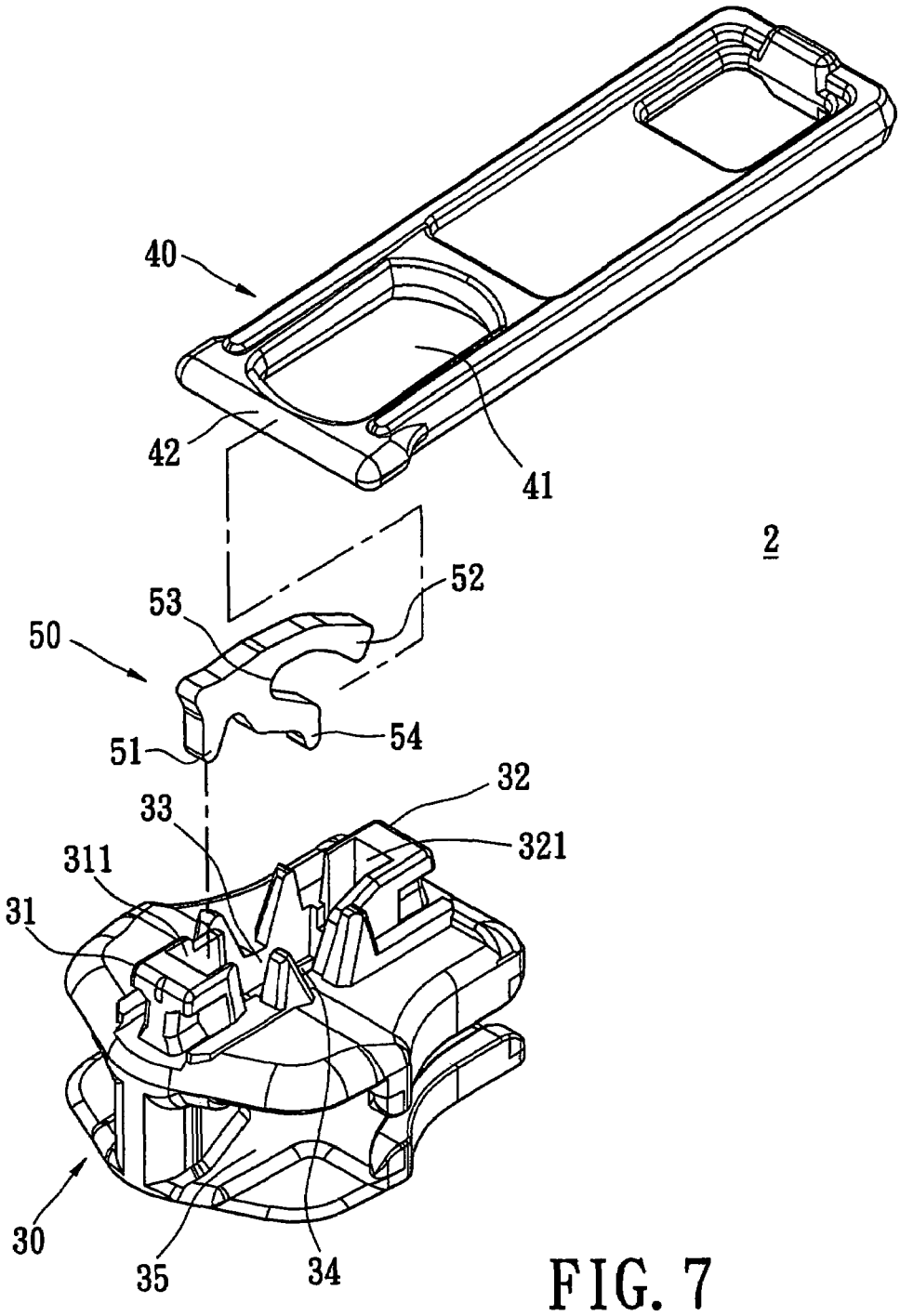
FIG. 7 is an exploded view of the slide of the semi-finished zipper according to the present invention.
Figure 8:
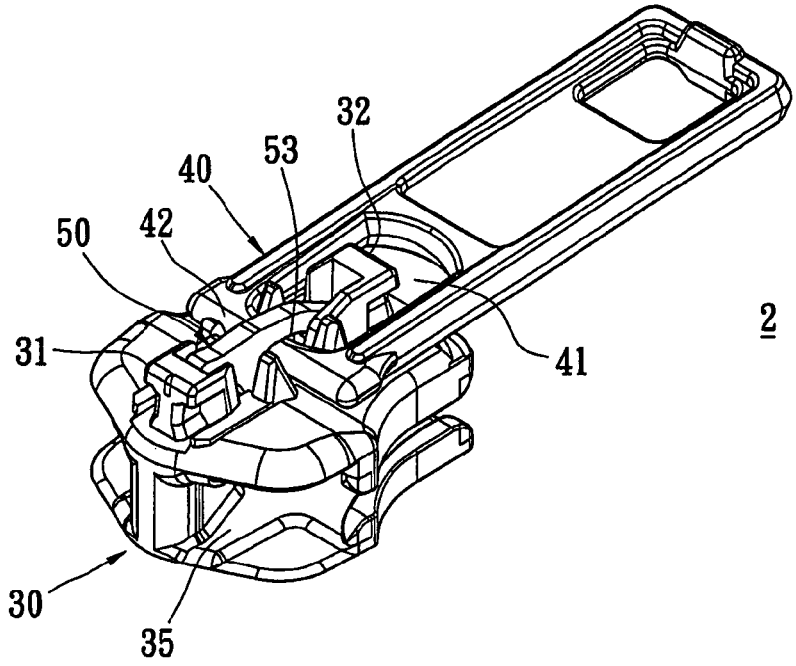
FIG. 8 is a perspective view of the slide of the semi-finished zipper according to the present invention.
Figure 9:
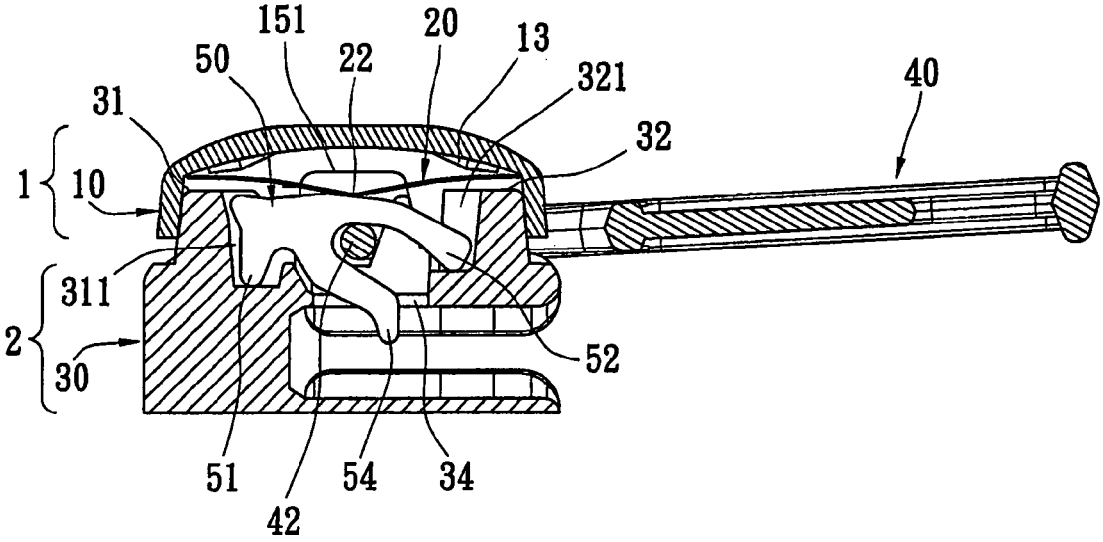
FIG. 9 is a cross-sectional view of the slide of the semi-finished zipper with the cap structure.

Please refer to FIGS. 7 to 9. The cap structure 1 of the present invention can be assembled to a slide of a semi-finished zipper 2 to form a zipper slide. The slide of the semi-finished zipper 2 includes a zipper slide, a pull tab 40, and a hook 50.

The opposite ends of the top surface of the slide of the zipper 30 have a first holding base 31 and a second holding base 32 respectively. The first holding base 31 and the second holding base 32 each have a first recess 311 and a second recess 321. Between the first holding base 31 and second holding base 32 there is a cavity 33. The bottom surface of the cavity 33 has a hook hole 34. The slide of the zipper 30 has a sliding groove 35. The sliding groove 35 passes through the two ends of the slide of the zipper 30 and communicates with the hook hole 34.

One end of the pull tab 40 has a hole 41. The pull tab 40 has a terminal portion 42 at the end near the hole 41.

One end of the hook 50 has a front portion 51, and a second end of the hook 50 has a back portion 52. Between the front portion 51 and the back portion 52, the hook 50 has a concave curved middle portion 53. The middle portion 53 has a blocking portion 54.

When a manufacturer wants to assemble the slide of the zipper structure, the manufacturer can follow the steps as described below. First, the terminal portion 42 of the pull tab 40 is disposed in the cavity 33 of the zipper-slide 30, and the hole 41 of the pull tab 40 is put around the first holding base 31 or the second holding base 32.

Next, the hook 50 is attached on the first holding base 31 and the second holding base 32. The front portion 51 of the hook 50 is disposed in the first recess 311 of the first holding base 31. The back portion 52 of the hook 50 is attached to the bottom of the second holding base 321 of the second holding base 32. The middle portion 53 of the hook 50 is attached to the terminal portion 42 of the pull tab 40. The blocking portion 54 of hook 50 is disposed in the sliding groove 35 of the slide of the zipper 30 via the hook hole 34 between the first holding base 31 and second holding base 32. Therefore, the slide of the semi-finished zipper 2 is completed.

Please refer to FIG. 9. The cap structure 1 of the present invention can be covered on the slide of the semi-finished zipper 2. The hook 50 and the first holding base 31 and the second holding base 32 of the slide of the zipper 30 are disposed within the cap 10. The terminal portion 42 of the pull tab 40 passes through the two recess openings 151 of the cap 10. The contact portion 22 of the resilient tap 20 attaches to the hook 50 to form a slide of the zipper structure. The slide of the zipper structure is hooked via a blocking portion 54 hooked in interlocking teeth of a zipper tape (not shown in the figure). Therefore, the slide of the zipper structure is stuck when the pull tab 40 is not being pulled.

When the pull tab 40 is pulled, the hook 50, which is attached to the terminal portion 42 of the pull tab 40, pushes the resilient tap 20 upwardly. At the same time, the blocking portion 54 is pulled out of the interlocking teeth of the zipper tapes. Therefore, the pull tab 40 can pull the slide of the zipper structure moving along the zipper tapes for closing or separating the zipper tapes.

When the pull tab 40 is released, the hook 50, which is attached to the terminal portion 42 of the pull tab 40, releases the force of pushing the resilient tap 20. Therefore, the blocking portion 54 of the hook 50 hooks the interlocking teeth of the zipper tapes, and the zipper tapes are locked.

In conclusion, the limiting portion 152 of the cap 10 installs the cap 10 in the resilient tap 20 to combine the resilient tap 20 and cap 10 to the cap structure 1. When a manufacturer assembles the zipper slide, the manufacturer just assembles the cap structure 1 on the slide of the zipper 30. Therefore, the assembly of a slide of the zipper is simpler.

Moreover, the two ends of the resilient tap 20 have the receiving portion 21 to increase the resilience of the resilient tap 20. The inside of the cap 10 has the concave portion 14 for the resilient tap 20 to allow bend. Therefore, a user just uses a small force to push the pull tab 40 to bend the resilient tap 20 and pull up the hook moving. Furthermore, the slide of the zipper is moved easier.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A cap structure for a zipper, comprising:

a longitudinally extended cap having a containing groove formed on the bottom surface thereof, a plurality of lugs being disposed on the bottom surface of the containing groove, the bottom surface of the containing groove having a concave portion beside each of the lugs, the bottom of the concave portion being lower than the top of the lugs, two sides of the cap having a side wall respectively, each of the side walls having a recess opening communicating with the containing groove, and the side walls having respective a limiting portions near the recess opening, the limiting portions being longitudinally offset one from the other;

a resilient tap disposed within the containing groove, the resilient tap abutting against the limiting portions, the resilient tap having a plurality of receiving portions corresponding to the lugs for substantially locking engagement therewith against relative longitudinal displacement.

2. The cap structure for a zipper as claimed in claim 1, wherein the lugs are disposed on the opposite ends of the containing groove, and the receiving portions are disposed on the two ends of the resilient tap corresponding to the lugs.

3. The cap structure for a zipper as claimed in claim 1, wherein the containing groove is disposed between the opposite sides of each of the lugs and the walls of the cap.

4. The cap structure for a zipper as claimed in claim 1, wherein each of the limiting portions is bent from the side wall to the containing groove.

5. The cap structure for a zipper as claimed in claim 1, wherein the limiting portions are disposed in a diagonal position.

6. The cap structure for a zipper as claimed in claim 1, wherein the limiting portions are defined by terminal edges of the side walls at opposite portions of the cap turned inward toward the containing groove.

7. The cap structure for a zipper as claimed in claim 1, wherein the middle of the resilient tap is bent downwardly to form a contact portion.

8. The cap structure for a zipper as claimed in claim 1, wherein the receiving portions are apertures.

9. The cap structure for a zipper as claimed in claim 1, wherein the receiving portions are grooves passing through the surfaces of the opposite ends.

* * * * *